US006621026B1

(12) United States Patent
Wei

(10) Patent No.: US 6,621,026 B1
(45) Date of Patent: Sep. 16, 2003

(54) LAMP ASSEMBLY INCLUDING PULL SWITCH AND TOUCH SWITCH

(76) Inventor: Jung-Tsung Wei, No. 176, Section 2, Tong-Man Road, Tainan City (TW)

( * ) Notice: Subject to any disclaimer, the term of this patent is extended or adjusted under 35 U.S.C. 154(b) by 0 days.

(21) Appl. No.: 10/082,103

(22) Filed: Feb. 26, 2002

(51) Int. Cl.[7] ..... F21V 23/04; H01R 33/955; H01H 17/00

(52) U.S. Cl. ..... 200/330; 200/51.15; 315/362; 362/394

(58) Field of Search ..... 200/51.15, 413, 200/418, 420, 423, 543, 330–339, 600; 362/395, 394; 315/362

(56) References Cited

U.S. PATENT DOCUMENTS 1,463,463 A * 7/1923 Evans et al. ..... 200/51.15
1,565,082 A * 12/1925 Freeman ..... 200/51 R
2,014,217 A * 9/1935 Williamson ..... 200/51.15 X
2,335,919 A * 12/1943 Deters ..... 200/35 R
4,101,805 A * 7/1978 Stone ..... 200/600 X
4,766,353 A * 8/1988 Burgess ..... 315/362 X

* cited by examiner

*Primary Examiner*—J. R. Scott

(57) ABSTRACT

A lamp assembly includes a base and a post extending from the base. A socket is connected to a top of the post and has an aperture. A control member and a pull switch are received in the socket and connected to each other. An electrical cable is connected to the control member via the base and the post. A bulb frame is connected to the socket and a first connection wire connected between the control member and the bulb frame. A second connection wire is connected between the pull switch and the bulb frame. A chain is connected to the pull switch and extends through the aperture of the socket. The control member is activated by touching the chain.

4 Claims, 4 Drawing Sheets

LAMP ASSEMBLY INCLUDING PULL SWITCH AND TOUCH SWITCH

FIELD OF THE INVENTION

The present invention relates to a lamp assembly that has a control member connected to a pull switch and a chain. The control member is activated either by pulling the chain or touch the chain.

BACKGROUND OF THE INVENTION

A conventional lamp assembly is shown in FIGS. 1 and 2 and generally includes a base 1 with a post 11 extending therefrom and a socket 21 is connected to a top of the post 11. An electrical cable 5 extends through the post 11 and is connected to a pull switch 3 and a bulb frame 22 respectively by two wires 51 and 52. A connection wire 6 is connected between the bulb frame 22 and the pull switch 3. A chain 31 is connected to the pull switch 3 and extends through an aperture 24 of the socket 21. The bulb frame 22 has an insertion portion 221 which is inserted in the socket 21 and a flange 222 extends from the bulb frame 22 and is rested on a top edge of the socket 21. A positioning member 23 has an inner threaded periphery 232 which is threadedly connected to an outer threaded periphery of the socket 21 so as to position the bulb frame 22. A bulb 4 is then connected to the bulb frame 22.

The conventional pull switch is activated by pulling the chain 31 and the interior parts of the switch are easily to be worn out due to frequent operations and the chain 31 could be broken.

SUMMARY OF THE INVENTION

The present invention relates to a lamp assembly which comprises a base with a post extending from the base and a socket is connected to a top of the post so as to be connected to a bulb frame thereto. An aperture is defined through the socket in which a control member and a pull switch are respectively received. An electrical cable is connected to the control member and a first connection wire is connected between the control member and the bulb frame. A second connection wire is connected between the pull switch and the bulb frame.

A chain is connected to the pull switch and extends through the aperture of the socket. The control member is activated by either pulling the chain or touching the chain.

The primary object of the present invention is to provide a lamp assembly wherein the bulb of the lamp assembly is controlled by a control member which can be activated by either pulling the chain or touching the chain.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
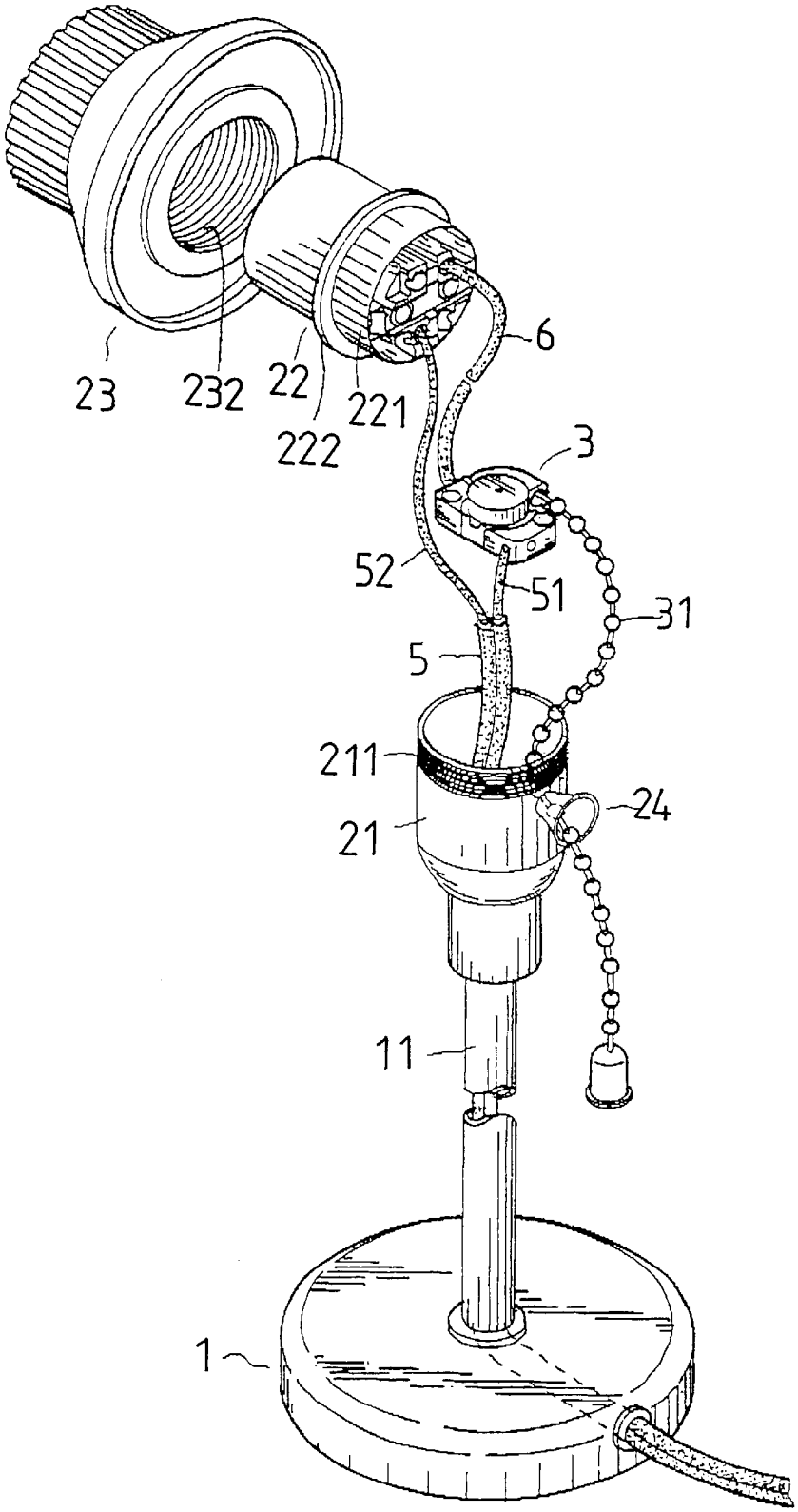
FIG.1 PRIOR ART
FIG. 1 is an exploded view to show a conventional lamp assembly.
Figure 2:
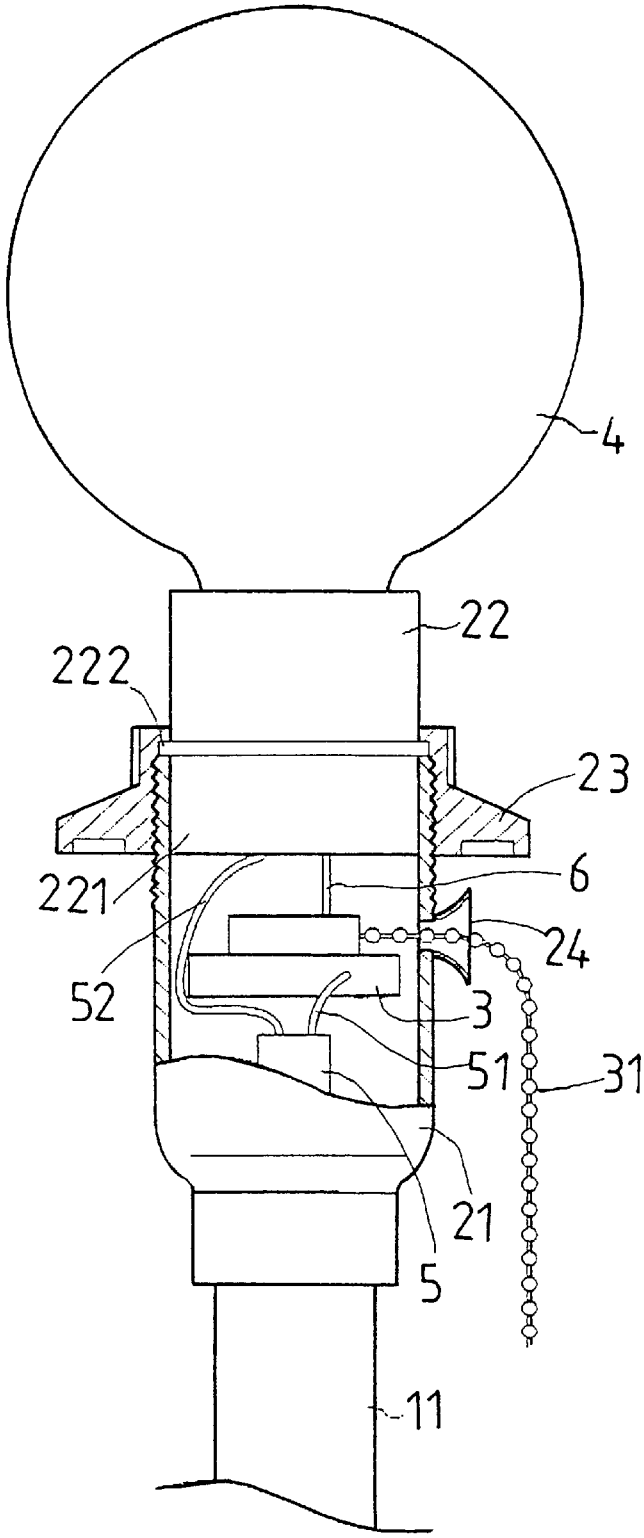
FIG.2 PRIOR ART
FIG. 2 is a cross sectional view to show conventional lamp assembly.
Figure 3:
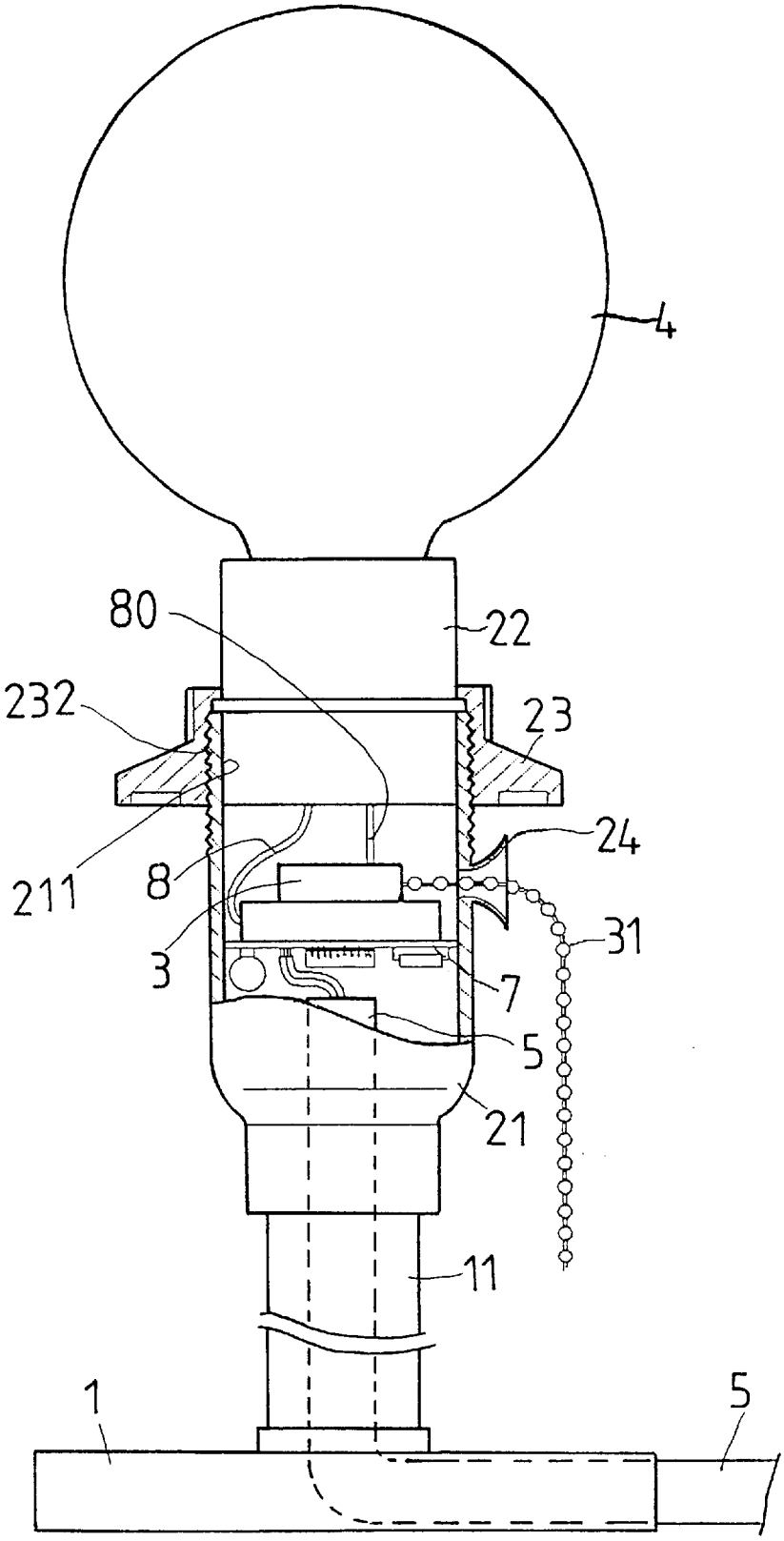
FIG. 3 is a cross sectional view to show the lamp assembly of the present invention.

Referring to FIG. 3, the lamp assembly of the present invention comprises a base 1 and a post 11 extending from the base 1. A socket 21 is connected to a top of the post 11 and has an aperture 24 defined through the wall of the socket 21. An outer threaded periphery 211 is defined in an outer periphery of the socket 21.

A control member 7 is received in the socket 21 and a pull switch 3 is connected to the control member 7. An electrical cable 5 extends through the base 1 and is located in the socket 21.

A bulb frame 22 has an insertion portion 221 which is inserted in the socket 21 and a flange 222 extends from the bulb frame 22 and is rested on a top edge of the socket 21. A bulb 4 is connected to the bulb frame 22. A positioning member 23 has an inner threaded periphery 232 which is threadedly connected to the outer threaded periphery of the socket 21. A position flange 231 extends inward from an inner periphery of the top of the positioning member 23 so that the bulb frame 22 is positioned by the position flange 231.

A first connection wire 8 is connected between the control member 7 and the bulb frame 22, and a second connection wire 80 is connected between the pull switch 3 and the bulb frame 22.

A chain 31 is connected to the pull switch 3 and extends through the aperture 24 of the socket 21. The control member 7 is activated either by touching the chain 31 or pulling the chain 31.

Figure 4:
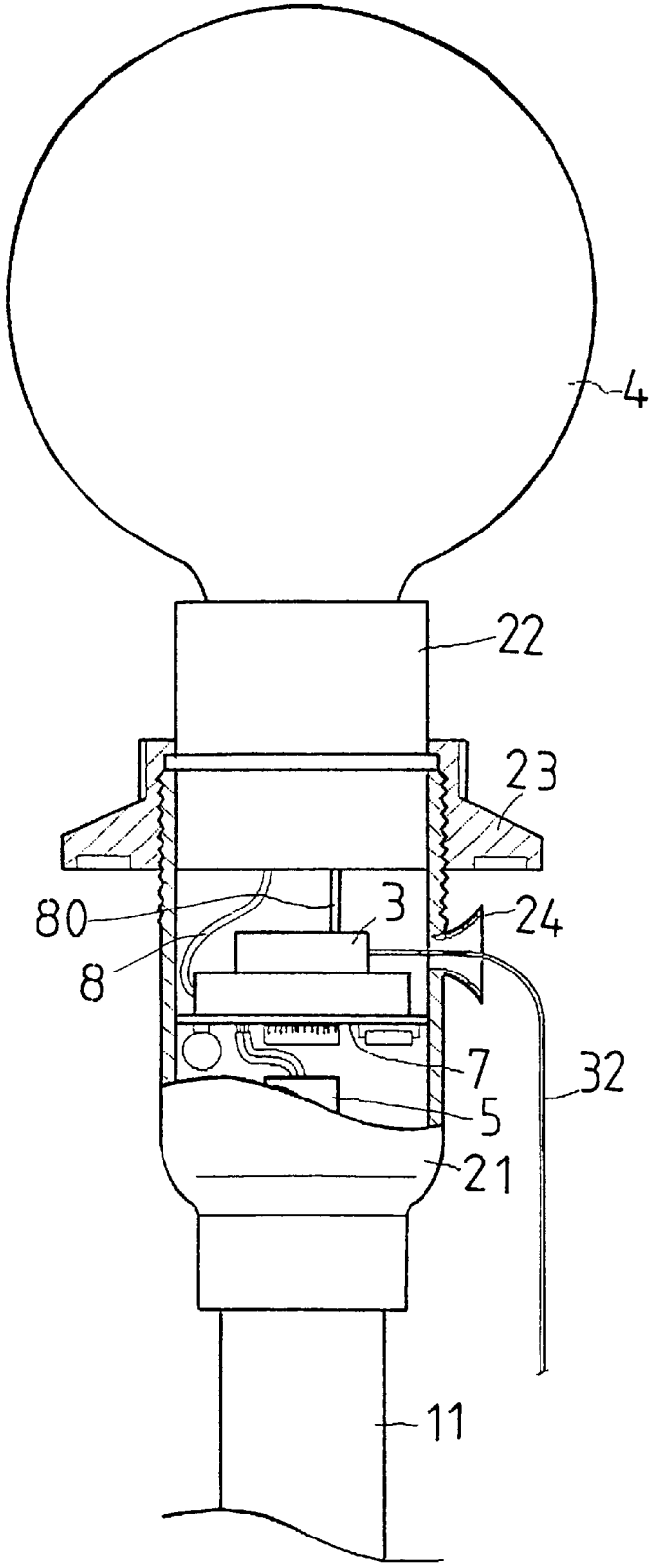
FIG. 4 is a cross sectional view to show that the chain is replaced with a cord.

As shown in FIG. 4, the chain 31 can be replaced with a cord 32 which is able to perform the same function as the chain 31.

While we have shown and described the embodiment in accordance with the present invention, it should be clear to those skilled in the art that further embodiments may be made without departing from the scope of the present invention.

What is claimed is:

1. A lamp assembly comprising:

(a) a base including a socket extending therefrom, said socket having an aperture formed therein;

(b) a bulb frame coupled to said socket for receiving a bulb element;

(c) a pull switch disposed in said socket and electrically connected to said bulb frame, said pull switch including at least one actuation member extending therefrom, said pull switch being operable to selectively energize said bulb frame responsive to user manipulation of said actuation member in a predetermined manner; and, (d) a control member disposed in said socket and electrically connected to said bulb frame for independently energizing said bulb frame in touch sensitive manner, said control member being electrically connected to at least a portion of said pull switch for actuation responsive to user touch of said actuation member.

2. The lamp assembly as recited in claim 1 further comprising a positioning member threadedly coupled to said socket for securing said bulb frame relative to said socket.

3. The lamp assembly as recited in claim 1 wherein said actuation member forms a chain.

4. The lamp assembly as recited in claim 1 wherein said actuation member forms a cord.

* * * * *